US011458055B2

(12) United States Patent
Tiu et al.

(10) Patent No.: US 11,458,055 B2
(45) Date of Patent: Oct. 4, 2022

(54) MOBILITY DEVICE FOR ASSISTING A PATIENT

(71) Applicant: Logistics and Supply Chain MultiTech R&D Centre Limited, Telegraph Bay (HK)

(72) Inventors: Kwai Yuen Tiu, Telegraph Bay (HK); Yuan Da Lau, Telegraph Bay (HK); Tim Ming Wong, Telegraph Bay (HK); King Sau Wong, Telegraph Bay (HK); Yan Nei Law, Telegraph Bay (HK)

(73) Assignee: Logistics and Supply Chain MultiTech R&D Centre Limited

( * ) Notice: Subject to any disclaimer, the term of this patent is extended or adjusted under 35 U.S.C. 154(b) by 0 days.

(21) Appl. No.: 17/098,988

(22) Filed: Nov. 16, 2020

(65) Prior Publication Data

US 2022/0151850 A1 May 19, 2022

(51) Int. Cl.
*A61G 7/10* (2006.01)
*A61G 7/00* (2006.01)

(52) U.S. Cl.
CPC ..... *A61G 7/1046* (2013.01); *A61G 7/1019* (2013.01); *A61G 7/1023* (2013.01); *A61G 7/1025* (2013.01); *A61G 2203/10* (2013.01); *A61G 2203/34* (2013.01)

(58) Field of Classification Search
CPC .... A61G 7/1046; A61G 7/1048; A61G 7/104; A61G 7/1019; A61G 7/1023; A61G 7/1013; A61G 7/1025; A61G 2203/10; A61G 2203/34
USPC ..... 5/87.1, 89.1, 86.1, 83.1, 81.1 R
See application file for complete search history.

(56) References Cited

U.S. PATENT DOCUMENTS 3,407,413 A * 10/1968 James ..... A61G 7/1019 5/87.1
3,877,421 A * 4/1975 Brown ..... A61G 7/1067 601/23
4,680,819 A * 7/1987 James ..... A61G 7/1046 5/83.1
4,703,523 A * 11/1987 James ..... A61G 7/1017 5/83.1
5,379,468 A * 1/1995 Cassidy ..... A61G 5/045 280/304.1
5,892,180 A * 4/1999 Carey ..... G01G 19/44 177/144
6,201,195 B1 * 3/2001 Carey ..... A61G 7/1017 177/144
6,806,430 B2 * 10/2004 Downing ..... G01G 19/44 177/144
7,802,328 B2 * 9/2010 Lingegard ..... A61G 7/1078 5/83.1

(Continued)

*Primary Examiner* — Robert G Santos
(74) *Attorney, Agent, or Firm* — Renner, Kenner, Greive, Bobak, Taylor & Weber

(57) ABSTRACT

A mobility device for assisting a patient includes a frame having a wheel arranged to maneuver the mobility device; a lift assembly coupled to the frame and movable between a lowered position and a raised position; and a support arm coupled to the lift assembly for movement with the lift assembly and arranged to support an upper part of a body of the patient and to support at least part of his weight on the mobility device when the lift assembly is raised from the lowered position to the raised position and when maneuvering the mobility device.

18 Claims, 3 Drawing Sheets

(56) References Cited

U.S. PATENT DOCUMENTS

| | | | | |
|---|---|---|---|---|
| 8,060,958 | B1 * | 11/2011 | Hough | A61G 7/1017 5/83.1 |
| 8,856,981 | B1 * | 10/2014 | Rayess | A61G 7/1011 5/83.1 |
| 9,161,871 | B2 * | 10/2015 | Clement | A61G 7/1046 |
| 10,478,361 | B2 * | 11/2019 | Harmeyer | A61G 7/1042 |
| 2002/0153176 | A1 * | 10/2002 | Downing | G01G 19/44 177/144 |
| 2009/0307840 | A1 * | 12/2009 | Lingegard | A61G 7/1065 5/83.1 |
| 2012/0174314 | A1 * | 7/2012 | Clement | A61G 7/1019 5/81.1 R |
| 2017/0000673 | A1 * | 1/2017 | Harmeyer | A61G 7/1017 |
| 2022/0151850 | A1 * | 5/2022 | Tiu | A61G 7/1023 |

* cited by examiner

MOBILITY DEVICE FOR ASSISTING A PATIENT

TECHNICAL FIELD

The present invention relates to mobility devices, and particularly, although not exclusively, mobility devices for assisting a patient for rehabilitation.

BACKGROUND

Patient lifts are usually used and controlled by an operator to transfer a patient between a bed and a chair or other resting places. They are particularly useful for patients with a weak lower body part who have difficulties in standing or walking by themselves, for example due to lost physical abilities result from a disease or injury, or as a side effect from a medical treatment. The patient lifts are often used with a sling attached to and hoisted in a single upward direction by the lift, and wrapped around the lower body part of the patient, to support the entire weight of the patient during lifting and transferring.

Often, the lost physical abilities required for the patients' daily life can be regained through rehabilitation, thus improving their daily life and functioning.

However, using the conventional patient lifts may impede the patients from rehabilitation, because the patient may lose muscle memory to stand up or sit down from relying solely on the lift and the sling in long term.

SUMMARY OF THE INVENTION

It is an object of the invention to address the above needs, to overcome or substantially ameliorate the above disadvantages or, more generally, to provide a mobility device that is able to generate real human sit-to-stand trajectory for muscle training and rehabilitation.

In accordance with a first aspect of the invention, there is provided a mobility device for assisting a patient, comprising: a frame having a wheel arranged to manoeuvre the mobility device; a lift assembly coupled to the frame and movable between a lowered position and a raised position; and a support arm coupled to the lift assembly for movement with the lift assembly and arranged to support an upper part of a body of the patient and to support at least part of his weight on the mobility device when the lift assembly is raised from the lowered position to the raised position and when maneuvering the mobility device.

Preferably, the support arm is movable relative to the lift assembly.

More preferably, the support arm is slidable between a retracted position in which the support arm is proximal to the lift assembly, and an extended position in which the support arm is distal to the lift assembly.

More preferably, the support arm is slidable along a substantially horizontal axis.

In a preferred embodiment, the lift assembly comprises a lift linkage movable along a substantially vertical axis, and a pivot linkage coupled to the lift linkage and the support arm, and wherein the pivot linkage is pivotable relative to the lift linkage between the lowered position and the raised position when the lift linkage is moved along the substantially vertical axis.

Preferably, the pivot linkage is pivotable about a pivot axis perpendicular to an axis parallel to the substantially vertical axis.

More preferably, the pivot linkage is coupled to the frame and the pivot axis is arranged along the frame.

In a preferred embodiment, the support arm comprises a grip portion for the patient to grip and an arm support portion coupled to the grip portion for supporting at least part of an arm of the patient.

Preferably, the grip portion comprises a U-shaped structure.

More preferably, the arm support portion is arranged to extend from each end of the U-shaped structure.

More preferably, the mobility device further comprises a pressure sensor coupled to the support arm.

More preferably, the pressure sensor is coupled to the arm support portion.

In a preferred embodiment, the support arm comprises a sling holder for holding a sling arranged to support a lower part of the body of the patient.

Preferably, the sling holder comprises a hook structure or a ring structure.

Preferably, the frame comprises a base coupled to the wheel and having two legs and a crossbar coupled between the two legs.

More preferably, each of the two legs is pivotable relative to the crossbar about a pivot axis substantially parallel to the substantially vertical axis.

More preferably, each of the two legs is pivotable at an angle between 90° and 120°.

In a preferred embodiment, a handle coupled to the frame for an operator to manoeuvre the mobility device for use by the patient.

In a preferred embodiment, a smart device for determining identity information of the patient, and the mobility device is configured to: receive the identity information from the smart device, and determine a predetermined movement of the lift assembly between the lowered position and the raised position for the patient based on the received identity information.

Preferably, the mobility device is further configured to determine a predetermined movement of the support arm for the patient based on the received identity information.

More preferably, the mobility device is further configured to control movements of the lift assembly and the support arm based on the determined movements.

Preferably, the smart device comprises a face recognition device having a camera for capturing an image of at least part of a face of the patient.

BRIEF DESCRIPTION OF THE DRAWINGS

Embodiments of the invention will now be described, by way of example, with reference to the accompanying drawings in which.

DETAILED DESCRIPTION OF THE PREFERRED EMBODIMENT

Figure 1:
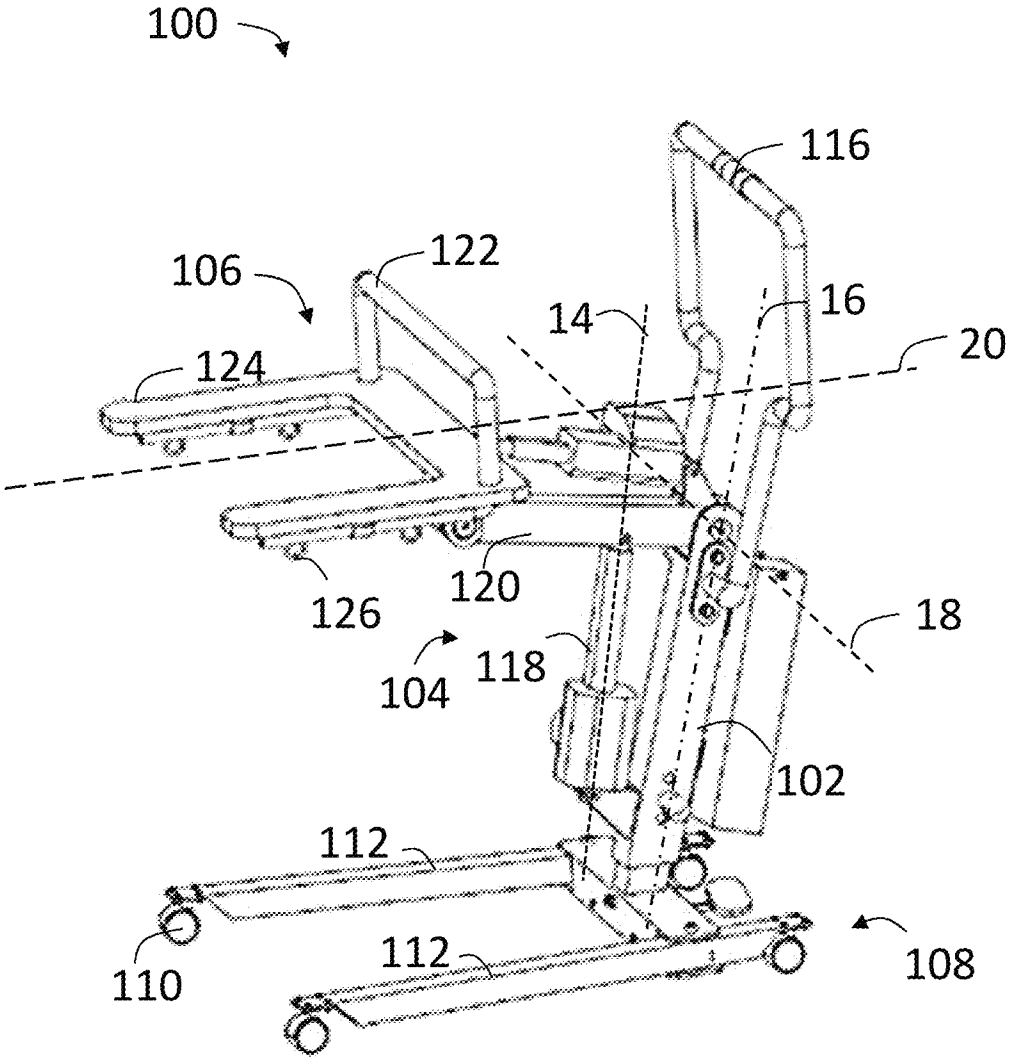
FIG. 1 is a perspective view of a mobility device in accordance with one embodiment of the present invention.

Before any embodiments of the invention are explained in detail, it is to be understood that the phraseology and terminology used herein is for the purpose of description and should not be regarded as limiting. Terms of degree, such as "substantially", "approximately", and "about" are understood by those of ordinary skill to refer to reasonable ranges outside of the given value, for example, general tolerances associated with manufacturing, assembly, and use of the described embodiments.

The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

It should be noted that a plurality of hardware and software-based devices, as well as a plurality of different structural components may be utilized to implement aspects of the invention. Furthermore, specific configurations described or illustrated in the drawings are intended to exemplify independent embodiments of the invention and that other alternative configurations are possible. The terms "controller", "processor", "central processing unit" and "CPU" are interchangeable unless otherwise stated. Where the terms "controller", "processor", "central processing unit" or "CPU" are used as identifying a unit performing specific functions, it should be understood that, unless otherwise stated, those functions can be carried out by a single processor or multiple processors arranged in any form, including parallel processors, serial processors, tandem processors or cloud processing/cloud computing configurations.

Figure 2:
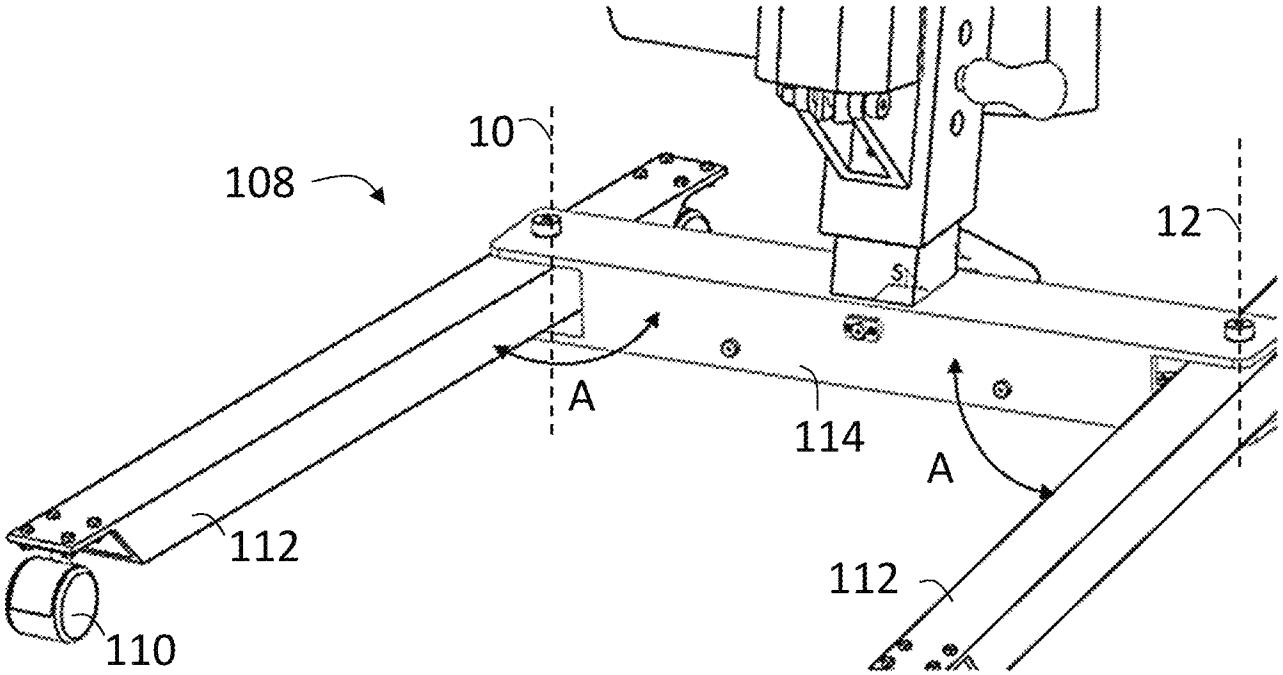
FIG. 2 is an enlarged view of a base of the mobility device of FIG. 1.

FIGS. 1 and 2 illustrate a mobility device 100 in accordance with one embodiment of the present invention. The mobility device 100 is designed for assisting a patient, particularly moving the patient from one position to another position in a safe and stable manner. The mobility device 100 may be a multi-functional mobility device that can be used as both a hoist and a walker. For example, the multi-functional mobility device 100 can be used to lift the patient from a sitting position to a standing position, to transfer the patient from a resting place to another resting place, as well as to support independent walking movement of the patient, for example for gait training.

In some example embodiments, the mobility device 100 may be particularly useful for patients that have a relatively weak lower body but capable of independently controlling their upper body and supporting a sufficient amount (e.g. above about 60%) of their weight. The mobility device 100 can be operated by an operator to move the patient, or directly controlled by the patient to move himself, for example, for rehabilitation, or additionally operated automatically using a smart device (as will be discussed later).

Referring to FIG. 1, the mobility device 100 includes a frame 102, a lift assembly 104 coupled to the frame 102, and a support arm 106 coupled to both the lift assembly 104 and the frame 102. The frame 102 includes a base 108 coupled to a plurality of wheels 110 (e.g. four wheels as shown in FIG. 1) arranged to manoeuvre the mobility device 100, such as on ground or floor surfaces. The wheels 110 may each be a rigid caster wheel or a swivel caster wheel that allows for a free rotation about 360°. The wheels 110 may each include a locking element (not shown) for locking the wheels 110 in position. Advantageously, when maneuvering the mobility device 100, or when lifting the patient from the sitting position to the standing position, the locking function prevents any inadvertent movement of the mobility device 100 thus preventing the patient from falling from the mobility device 100 and getting injured.

The mobility device 100 further includes a handle 116 coupled to the frame 102, preferably extending upwardly from the frame 102, for the operator to manoeuvre the mobility device 100 for use by the patient, e.g. when the mobility device 100 is used in the mode which completely lifts the patient from one position to another.

In this embodiment, the mobility device 100 includes a foldable structure. For example, the lift assembly 104 and the support arm 106 may be foldable relative to each other and the frame 102 so that the mobility device 100 may be stored with a more compact structure.

The support arm 106 is movable with the lift assembly 104 between a lowered position and a raised position. The lowered and raised positions may correspond to a sitting position and a standing position of the patient, respectively. During use, the support arm 106 is arranged to support an upper part of a body of the patient and to support at least part of his weight on the mobility device 100, thus reducing the weight exerted on and bearing through his lower body, thereby facilitating rehabilitation. In addition, by moving the support arm 106 to different level raised from the base or the ground, the mobility device may be adjusted to be used by different patient with different height.

As shown in FIG. 1, the support arm 106 is movable via a multi-axis movement and support mechanism. To accomplish movement between the lowered position and the raised position, the lift assembly 104 is provided with a lift linkage 118 movable along a substantially vertical axis 14, and a pivot linkage 120 coupled between the lift linkage 118 and the support arm 106, and to the frame 102. The substantially vertical axis 14 is arranged along the length of the lift linkage 118. The substantially vertical axis 14 is substantially parallel to an axis 16 defined by the upwardly-extending length of the frame 102. Advantageously, the multi-axis mechanism allow the position and elevation of the support arm to be adjusted to facilitate different heights and postures of different patients in a rehabilitation operations.

The pivot linkage 120 of the support arm 106 is pivotable about a pivot axis 18 relative to the lift linkage 118 and the frame 102 between the lowered position and the raised position when the lift linkage 118 is moved along the substantially vertical axis 14. The pivot axis 18 is arranged along and perpendicular to the axis 16 defined by the frame 102. Specifically, an upward movement of the lift linkage 118 acts upon the pivot linkage 120, causing the pivot linkage 120 to pivot about the pivot axis 18 relative to the frame 102 towards the raised position, and vice versa. The coupling mechanism between the pivot linkage 120 and the lift linkage 118 is well-known in the art, so it will not be discussed in any further details herein.

In addition to movement with the lift assembly 104 between the lowered and raised positions, the support arm 106 is also independently movable relative to the lift assembly 104. In particular, the support arm 106 is slidable along a substantially horizontal axis 20 between a retracted position in which the support arm 106 is proximal to the lift assembly 104, and an extended position in which the support arm 106 is distal to the lift assembly 104. The support arm 106 enables the patient to adjust their hand position, making him more comfortable and secure during lifting, transferring, or walking.

Optionally or additionally, the support arm 106 also includes a grip portion 122 for the patient to grip and an arm support portion 124 coupled to the grip portion 122 for supporting at least part of an arm (e.g. the fore arm) of the patient. Preferably, the grip portion 122 has a U-shaped structure, such that the patient can ergonomically hold different parts of the U-shaped structure 122 in an upright position or a side-by-side position conveniently. The arm support portion 124 is arranged to extend from each end of the U-shaped structure 122 to provide proper support for the arm of the patient. In the illustrated embodiment, the arm support portion 124 includes parts that are sufficiently long to support the entire forearm of the patient.

In addition, one or more pressure sensor(s) (not shown) is coupled to the support arm 106, preferably inside or underneath the arm support portion 124. For example, the pressure sensor is configured to detect the force exerted by the patient on the arm support portion 124, which may be used to control movements of the lift assembly 104 and the support arm 106 based on a comparison between the detected force and a threshold pressure value, or analyse the process of rehabilitation based on a comparison between the detected force and the weight of the patient.

To appropriately support the body of the patient, in addition to the grip portion 122 and the arm support portion 124 of the support arm 106, the support arm 106 further includes a sling holder 126 for holding a sling (not shown) arranged to support a lower part of the body of the patient, similar to a conventional sling used in patient hoists. Together, the grip portion 122, the arm support portion 124, and the sling support a substantially amount of weight of the patient, allowing forces exerted on his lower body and required to stand or walk to be minimised, thus facilitating rehabilitation. The sling holder 126 may include a hook structure or a ring structure to maintain the sling thus the patient thereon when the lift assembly 104 is raised from the lowered position to the raised position and when maneuvering the mobility device 100.

To better assist in operating the mobility device 100, as illustrated in FIG. 2, the base 108 further includes two legs 112 and a crossbar 114 coupled between the two legs 112. Each of the two legs 112 is pivotable relative to the crossbar 114 about a respective pivot axis (pivot axis 10 and pivot axis 12 respectively) perpendicular to the ground and substantially parallel to axes 14, 16 at an angle A between 90° and 120°. These adjustable and pivotable legs 112 facilitate application of the mobile device 100 in different space by providing easy access to the resting places that the patient is sitting on or transferred from, e.g. chairs, wheelchairs or beds. In particular, the legs 112 may each be pivoted at 120° thus widening the distance between the legs 112, accommodating the width of the chairs, wheelchairs or beds, such that the mobility device 100 can be moved closer to the patient. The movement of legs 112 also allows the mobility device 100 to maintain the centre of gravity of the patient within the base 108 for stability.

The operation of the mobility device 100 is discussed in detail below. The mobility device 100 may be operated manually by an operator for use by a patient. This is implemented using different electrical components in the mobility device 100, such as switches and actuators (not shown) that can be controlled by the operator, and a controller for controlling operation of the mobility device 100, particularly movements of the lift assembly 104 and the support arm 106, based on the user input via the actuators. For example, the operator may select a desired height position for the lift assembly 104 using the actuator, and the controller controls the lift assembly 104 to move to the desired height position.

Additionally or alternatively, the mobility device 100 may be configured to operate automatically using a smart device that communicates information with the mobility device 100, to affect operation of the mobility device 100, particularly the movements of both the lift assembly 104 and the support arm 106.

Figure 3:
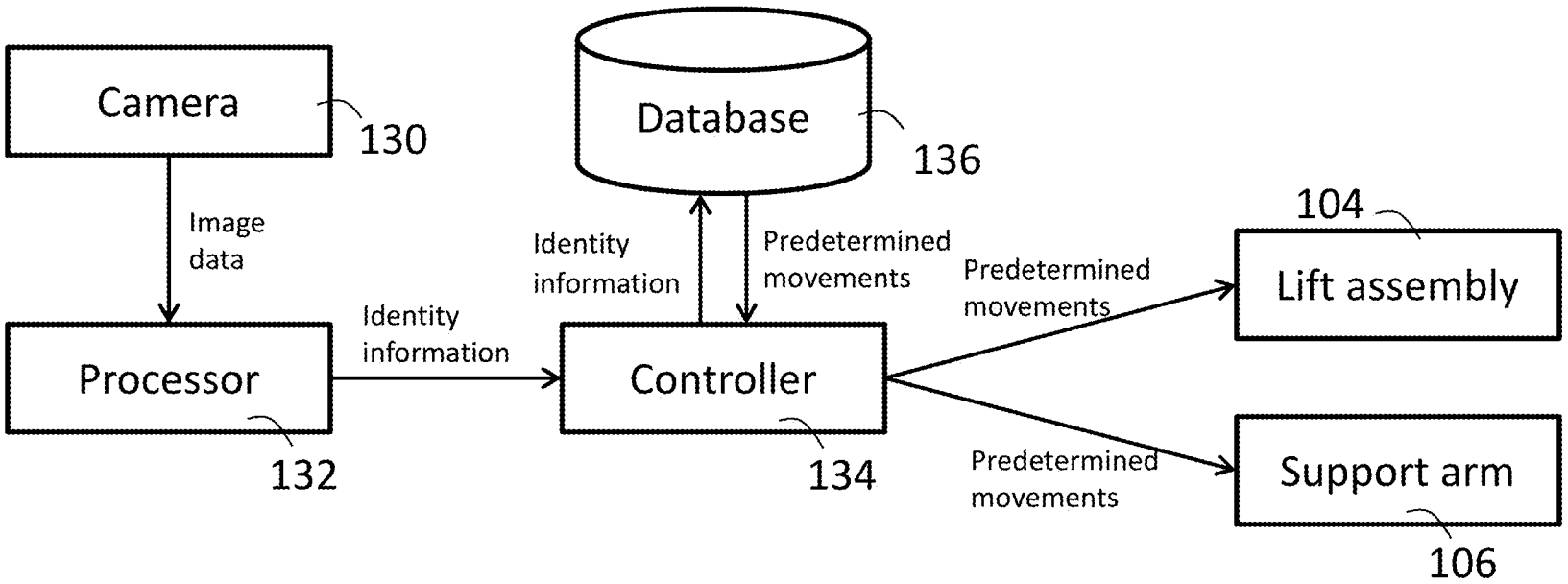
FIG. 3 is a block diagram of a mobility device in accordance with one embodiment of the present invention.

With reference also to FIG. 3, there is shown an example embodiment of the mobility device in communication with a smart device. The smart device may be incorporated into the mobility device 100, or may be a separate device from the mobility device 100 that is capable of communicating with the mobility device 100 through a wired connection or a wireless connection. Preferably, the smart device is a face recognition device incorporated with an AI vision system to determine identity information of the patient using the deep learning technique. The face recognition device also includes a user trajectory database storing specific movement trajectories (e.g. movement trajectories of the lift assembly and the support arm) for each specific patient so that the operator is not required to set and adjust movements of the lift assembly 104 and the support arm 106 for the same patient every time.

In this example, the face recognition device includes a camera 130 for capturing an image of at least part of a face of the patient. For example, the camera 130 may only capture the eye area of the patient, or may capture the entire face of the patient. The face recognition device also includes a processor 132 for processing data on the image (e.g. extracted from characteristics of the facial features) received from the camera 130, which contains identity information of the patient. The processor 132 is configured to send the identity information obtained from the image data to the controller 134 of the mobility device 100, which then compares the received identity information with the identity information of different users stored in the user trajectory database 136. Upon confirming a match, the controller 134 then retrieves the specific movement trajectories for that patient from the database 136, determines predetermined movements of the lift assembly 104 and the support arm 106 (e.g. between the lowered position and the raised position, and between the retracted position and the extended position), and controls the mobility device 100 according to the predetermined movements.

As discussed above, the present invention provides a multi-functional mobility device that may be used as a hoist as well as a walker, which assists a patient to be lifted from a sitting position to a standing position, and to move from one place to another place. The multi-functional mobility device is advantageous in that the patient can support his upper body part and at least part of his weight on the support arm, thus lessening the burden on his lower body part, providing the ability of gait training and rehabilitation. Further, the multi-functional mobility device can be operated both manually and automatically. For example, in the situation where the operator is one that lacks experience with the patient and without knowledge of the best movement trajectory for this patient, the mobility device with the smart device is particularly useful to determine and control the most appropriate movement trajectory for this patient.

It will be appreciated by persons skilled in the art that numerous variations and/or modifications may be made to the invention as shown in the specific embodiments without departing from the spirit or scope of the invention as broadly described. The structures and the shapes of the components of the mobility device may be different from those described in the above description and illustrated in the drawings. For example, the lift assembly may not be separated into a lift linkage and a pivot linkage and rely on both linear movement and pivotal movement. The lift assembly may be a single component capable of relying on either linear movement or pivotal movement to be moved from the lowered position to a raised position. As another example, the arm support portion may be shaped and sized to support only part of a forearm (e.g. an elbow), or parts other than a forearm of a patient. In addition to or replacing the face recognition device, the smart device may include a voice recognition device that assists the mobility device to control movement trajectories based on a voice recognised.

The described embodiments of the invention should therefore be considered in all respects as illustrative, not restrictive. Any reference to prior art contained herein is not to be taken as an admission that the information is common general knowledge, unless otherwise indicated.

The invention claimed is:

1. A mobility device for assisting a patient, comprising:

a frame having a wheel arranged to manoeuvre the mobility device;

a lift assembly coupled to the frame and movable between a lowered position and a raised position; and a support arm coupled to the lift assembly for movement with the lift assembly and arranged to support an upper part of a body of the patient and to support at least part of his weight on the mobility device when the lift assembly is raised from the lowered position to the raised position and when maneuvering the mobility device, the support arm being slidable relative to the lift assembly along a substantially horizontal axis between a retracted position in which the support arm is proximal to the lift assembly, and an extended position in which the support arm is distal to the lift assembly, the support arm including a grip portion, provided above the support arm, for the patient to grip and an arm support portion coupled to the grip portion for supporting an entire forearm of the patient placed above the arm support portion.

2. The mobility device according to claim 1, wherein the lift assembly comprises a lift linkage movable along a substantially vertical axis, and a pivot linkage coupled to the lift linkage and the support arm, and wherein the pivot linkage is pivotable relative to the lift linkage between the lowered position and the raised position when the lift linkage is moved along the substantially vertical axis.

3. The mobility device according to claim 2, wherein the pivot linkage is pivotable about a pivot axis perpendicular to an axis parallel to the substantially vertical axis.

4. The mobility device according to claim 3, wherein the pivot linkage is coupled to the frame and the pivot axis is arranged along the frame.

5. The mobility device according to claim 2, wherein the frame comprises a base coupled to the wheel and having two legs and a crossbar coupled between the two legs.

6. The mobility device according to claim 5, wherein each of the two legs is pivotable relative to the crossbar about a pivot axis substantially parallel to the substantially vertical axis.

7. The mobility device according to claim 6, wherein each of the two legs is pivotable at an angle between 90° and 120°.

8. The mobility device according to claim 1, wherein the grip portion comprises a U-shaped structure.

9. The mobility device according to claim 8, wherein the arm support portion is arranged to extend from each end of the U-shaped structure.

10. The mobility device according to claim 1, further comprising a pressure sensor coupled to the support arm.

11. The mobility device according to claim 10, wherein the pressure sensor is coupled to the arm support portion.

12. The mobility device according to claim 1, wherein the support arm comprises a sling holder for holding a sling arranged to support a lower part of the body of the patient.

13. The mobility device according to claim 12, wherein the sling holder comprises a hook structure or a ring structure.

14. The mobility device according to claim 1, further comprising a handle coupled to the frame for an operator to manoeuvre the mobility device for use by the patient.

15. The mobility device according to claim 1, further comprising a smart device for determining identity information of the patient, and the mobility device is configured to:

receive the identity information from the smart device, and determine a predetermined movement of the lift assembly between the lowered position and the raised position for the patient based on the received identity information.

16. The mobility device according to claim 15, wherein the mobility device is further configured to determine a predetermined movement of the support arm for the patient based on the received identity information.

17. The mobility device according to claim 16, wherein the mobility device is further configured to control movements of the lift assembly and the support arm based on the determined movements.

18. The mobility device according to claim 15, wherein the smart device comprises a face recognition device having a camera for capturing an image of at least part of a face of the patient.

* * * * *